US010941931B2

(12) United States Patent
Yu et al.

(10) Patent No.: US 10,941,931 B2
(45) Date of Patent: Mar. 9, 2021

(54) LIGHTING DEVICE, 3D-PRINTED COOLING ELEMENT, AND A METHOD OF PRODUCING A LIGHTING DEVICE

(71) Applicant: SIGNIFY HOLDING B.V., Eindhoven (NL)

(72) Inventors: Jianghong Yu, Best (NL); Manuela Lunz, Waalre (NL); Roy Antoin Bastiaan Engelen, Geleen (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/635,533

(22) PCT Filed: Jul. 19, 2018

(86) PCT No.: PCT/EP2018/069646

§ 371 (c)(1),
(2) Date: Jan. 30, 2020

(87) PCT Pub. No.: WO2019/025201

PCT Pub. Date: Feb. 7, 2019

(65) Prior Publication Data

US 2020/0256554 A1 Aug. 13, 2020

(30) Foreign Application Priority Data

Aug. 1, 2017 (EP) ..... 17184177

(51) Int. Cl.
*F21V 29/87* (2015.01)
*F21K 9/23* (2016.01)

(52) U.S. Cl.
CPC ..... *F21V 29/87* (2015.01); *F21K 9/23* (2016.08)

(58) Field of Classification Search
CPC ..... F21V 29/87; F21V 29/00; F21V 29/02; F21V 29/002; F21V 29/004; F21V 29/20; F21V 29/70; F21V 29/74; F21K 9/23
See application file for complete search history.

(56) References Cited

U.S. PATENT DOCUMENTS

| | | | | |
|---|---|---|---|---|
| 10,386,058 | B1 * | 8/2019 | Cattoni | F21S 8/061 |
| 2014/0272385 | A1 | 9/2014 | Dickinson et al. | |
| 2015/0036344 | A1 | 2/2015 | Chen et al. | |
| 2016/0346997 | A1 | 12/2016 | Lewis et al. | |

FOREIGN PATENT DOCUMENTS

| | | | |
|---|---|---|---|
| CN | 104552947 | A | 4/2015 |
| DE | 102015007791 | A | 12/2016 |
| DE | 102015215571 | A1 | 2/2017 |
| EP | 2590210 | A2 | 5/2013 |
| KR | 20160126801 | A | 11/2016 |

* cited by examiner

*Primary Examiner* — Joseph L Williams
*Assistant Examiner* — Jose M Diaz
(74) *Attorney, Agent, or Firm* — Daniel J. Piotrowski

(57) ABSTRACT

A lighting device having a 3D-printed heat sink. The 3D-printed heat sink includes a stack of a core layer and at least one further layer stacked along a stack axis normal to the core layer. The core layer and the at least one further layer having a same polymer material each with a thermally conductive filler, wherein a concentration of the thermally conductive filler in the polymer material decreases, starting from the core layer, consecutively with each of the at least one further layer for improving resistance to mechanical failure and thermal conduction of said 3D-printed heat sink.

15 Claims, 4 Drawing Sheets

LIGHTING DEVICE, 3D-PRINTED COOLING ELEMENT, AND A METHOD OF PRODUCING A LIGHTING DEVICE

CROSS-REFERENCE TO PRIOR APPLICATIONS

This application is the U.S. National Phase application under 35 U.S.C. § 371 of International Application No. PCT/EP2018/069646, filed on Jul. 19, 2018, which claims the benefit of European Patent Application No. 17184177.8, filed on Aug. 1, 2017. These applications are hereby incorporated by reference herein.

FIELD OF THE INVENTION

The invention relates to a lighting device comprising a light source and/or an electronic device, and comprising a 3D-printed heat sink. Said 3D-printed heat sink comprises a core layer and at least one further layer, wherein e.g. a light source and/or electronic device comprised by the lighting device may further be arranged on the core layer. The invention further relates to a heat sink and to a method of producing a lighting device comprising a 3D-printed heat sink.

BACKGROUND OF THE INVENTION

An operation of a lighting device is often associated with a generation of heat. Said heat is a byproduct that may have an injurious effect on the performance and the lifetime of the lighting device. Effective cooling is therefore useful and desired in many lighting devices. For cooling a lighting device, which may generate heat when in use, or when operated, heat sinks are often used.

A heat sink for improving the thermal performance of a lighting device is well known in the art. Since it is expected that the current practice in global manufacturing will be transformed by the widespread introduction of Digital Manufacturing, it is also expected that the design and manufacturing of such heat sinks will be digitalized; for example by means of Fused Deposition Modelling or 3D-printing.

However, at the moment, many lighting devices are still manufactured with conventional manufacturing techniques, because many lighting devices have a high luminous flux requirement and therefore require a metal heat sink to achieve a better heat spreading and consequently to meet desired cooling properties. Such a metal heat sink may be an aluminum heat sink. The trend of moving to smaller light sources in lighting devices, such as Chip on Board (CoB), further increases the requirement for efficient heat spreading and cooling by means of a metal heat sink.

Such a metal heat sink, for example an aluminum heat sink, is currently made by die casting. The mold for such a casting process requires tooling (per part and per design) and hence results in high manufacturing costs. Moreover, 3D-printing a metal heat sink is still very expensive and only efficient in producing a limited batch of small or very specialized parts. Digitally manufacturing a similar design (e.g. a substitute) 3D-printed polymer heat sink will be cost-effective, but such a (substitute) 3D-printed heat sink will lack the thermal properties in combination with the mechanical strength of a metal heat sink. Mechanical strength being a subject dealing with the behavior of solid objects subject to stresses and strains. This may be a problem. Namely, improving the heat conduction in a 3D-printed heat sink, e.g. by providing thermally conductive fillers in (e.g.) a (polymer) matrix material, may often result in a deterioration of mechanical strength of the matrix material. Such mechanical strength may e.g. be required for providing constructual strength, for ensuring good mechanical properties such as impact resistance or ductility, for resisting thermal loads, and/or for resisting physical loads.

Examples of such thermal or physical loads are: loads due to connecting the heat sink within the construction of the lighting device; thermal stresses occurring due to on/off, day/night/, sun/shade cycles; weight loads in the construction of the lighting device pressing on the heat sink; weather conditions such as wind, sun, rain, hail, snow; use loads such as hooliganism. As a result, merely substituting a known polymer heat sink for a metal heat sink may not be sufficient to overcome such mechanical loads and at the same time provide thermal dissipation of a heat load within the lighting device. Providing a known polymer heat sink to such a lighting device is thus disadvantageous.

SUMMARY OF THE INVENTION

It is an object of the invention to provide an improved lighting device comprising a 3D-printed heat sink, which at least alleviates the problem mentioned above. Thereto, the invention provides a lighting device comprising a light source and/or an electronic component, and comprising a 3D-printed heat sink; the 3D-printed heat sink comprises a stack of a core layer and at least one further layer stacked along a stack axis normal to the core layer; wherein the core layer and the at least one further layer comprise a same polymer material each with a thermally conductive filler, wherein a concentration of the thermally conductive filler in the polymer material decreases, starting from the core layer, consecutively with each of the at least one further layer for improving resistance to mechanical failure and heat conduction of said 3D-printed heat sink.

Such a lighting device comprises a 3D-printed heat sink, wherein the heat sink comprises a stack of a core layer and at least one further layer stacked along a stack axis normal to the core layer. Hence, the heat sink may comprise a stack of consecutively the core layer and the at least one further layer. Each layer of said stack comprises a same polymer material, which ensures that each layer of the stack is adhered well to each other. Each layer of said stack also comprises a thermally conductive filler for improving heat transfer through each respective layer. However, in many situations, the resistance to mechanical failure of a polymer decreases, as the concentration of the thermally conductive filler in the polymer material increases. More specifically, the resistance to mechanical failure here referring e.g. to the brittleness and ductility: The brittleness (and/or stiffness) of the stack increases for increasing thermally conductive filler content, making the stack deteriorate in ductility and prone to break or rupture sooner by deformation (i.e. a property of mechanical strength decreases). Although it is thermally desired to implement a thermally conductive filler, it is therefore not mechanically desired to provide each layer of said stack with a high concentration of thermally conductive filler. Hence, as mentioned before, the invention provides a 3D-printed heat sink, wherein a concentration of the thermally conductive filler in the polymer material decreases, starting from the core layer, consecutively with each of the at least one further layer for improving the relation between mechanical strength and heat conduction of said 3D-printed heat sink. Said relation being here the resistance to mechanical failure in relation to heat conduction. This (the invention)

renders the 3D-printed heat sink to have a relatively high mechanical strength properties, being a resistance to mechanical failure as mentioned, while preserving thermal performance. As mentioned, said mechanical strength properties e.g. being less brittle, being improved in ductility, being more resistant to break with increasing deformation while preserving thermal performance. Here, 3D-printing may for example be fused deposition modelling (FDM). Said concentration may be a uniform concentration throughout the polymer material. In some examples, said relation may be the ratio of mechanical strength, e.g. brittleness or ductility, and heat conduction of said 3D-printed heat sink. Here, resistance to mechanical failure may also be referred to as mechanical strength of a property of mechanical strength of the 3D-printed heat sink.

As a result, the core layer may provide less resistance to mechanical failure but higher thermal conductivity, and the at least one further layer may consecutively provide increasing resistance to mechanical failure and decreasing thermal conductivity. The effect of this configuration is that the resistance to mechanical failure of the heat sink and the thermal conductivity of the heat sink may be inversely proportional along the stack of said layers. Consequently, heat applied to the core layer of the heat sink may be dissipated faster over the stack of layers, for example over an initial few layers of the at least one further layer, while the overall resistance to mechanical failure of the heat sink may be preserved accordingly, for example because a final few layers of the at least one further may require less thermal conductivity as the heat is already dissipated over the initial few layers and hence provide more resistance to mechanical failure for improving the overall resistance to mechanical failure of the heat sink. Thus, as described here, the resistance to mechanical failure and heat conduction of the 3D-printed heat sink is also improved.

Resistance to mechanical failure refers to mechanical properties such as stiffness, brittleness, ductility, impact resistance, stress-strain behavior etc.; which are known in the field of mechanics of materials. Hence, an improved resistance to mechanical failure refers to e.g. a less brittle, more ductile, more impact resistant object, which is more resistant to break due to strain or deformation. Strain may refer to both mechanical as well as occurring thermal strain.

The advantage of the lighting device according to the invention is that a lighting device is provided with an improved 3D-printed (polymer) heat sink, which may transfer heat away from the light source and/or the electronic component. To be more specific: the heat sink is not only an advantageous substitute for a metal heat sink in said lighting device, but also an improvement compared to a known polymer heat sink; because the lighting device comprising said 3D-printed heat sink is easier and faster to produce, is more cost-effectively to manufacture without high upfront investment (like e.g. a die casting mold), and is providing a heat sink with improved and advantageous relation between resistance to mechanical failure and heat conduction properties. As a result, a traditional lighting device comprising (a metal heat sink or) a known polymer heat sink may be advantageously replaced by the lighting device comprising the 3D-printed polymer heat sink according to the present invention without losing the mechanical and thermal advantages provided by the metal heat sink; which is a clear disadvantage of a known polymer heat sink.

Provided with the present invention, it is expected that the design and manufacturing of heat sinks will be digitalized more effectively and sooner, because the present invention now provides a well-enabled advantageous polymer heat sink and/or advantageous substitute for metal heat sinks. For example, the invention may be advantageously applied for specific lighting devices present within the portfolio of Philips Lighting such as e.g. outdoor post-top lighting devices, or e.g. more specifically the Metronomis.

Another advantage is that Digital Manufacturing such a heat sink for use in said lighting device allows for cost-effectively producing small batch sizes and allows for personalized products. Such personalized products may for example be initiated and 3D-printed by a consumer.

The core layer comprises a concentration of the thermally conductive filler in the polymer material. Said concentration of the thermally conductive filler in the polymer material may allow the core layer to conduct heat effectively. As the concentration of the thermally conductive filler in the polymer material decreases, starting from the core layer, consecutively with each of the at least one further layer, the thermal conductivity of the heat sink decreases with each consecutive layer, but its resistance to mechanical failure increases. That is e.g. the stack becomes less brittle, more ductile and more resistant to break due to strain/deformation. A source of heat will therefore be more effectively dissipated when on the core layer, because the thermal conductivity is higher close to the source of heat. Thus, the heat may be distributed better over the core layer and increasingly less over each of the at least one further layer. However, the latter is acceptable, because the resistance to mechanical failure of the heat sink is preserved increasingly better over the at least one further layer and the requirement for thermal conductivity is increasingly less stringent over the at least one further layer as the heat is distributed more.

Thus, as mentioned before, a source of heat will therefore be more effectively dissipated when on the core layer. Hence, in an embodiment, the light source and/or the electronic device may be arranged on the core layer. More specifically, the light source and/or electronic device may be arranged on the core layer on a side facing away from the top layer. Such an embodiment is advantageous, because the light source and/or electronic device of the lighting device may be the component that produces most of the heat within the lighting device. Arranging the light source and/or electronic device onto the core layer improves the thermal performance of the lighting device. Alternatively, in an embodiment, the electronic component may be a battery, a processor, a resistance, a driver, an actuator, a chip or a semiconductor device, or a display.

Said light source may be a conventional light source, a lighting device, a solid state lighting device, a LED, an OLED, a LED board, a halogen spot, or a light guide, or a luminescent material, or a transparent window comprising a luminescent material.

For a better heat dissipation, it may further be advantageous to arrange the light source and/or the electronic device (such as e.g. a driver) at a specific location on the core layer, wherein the specific location may allow for better heat dissipation of the heat generated by the light source. Hence, in an embodiment, the light source and/or electronic device may be positioned at a geometric center of the core layer. Said geometric center may be the center of a geometric shape. For example, when the core layer has a circular shape, the geometric center may be the center of the circle; when the core layer has an elliptic shape, the geometric center may be one of the two focal points of the ellipse; when the core layer has a free shape, the geometric center may be the center of gravity. Alternatively, the center of inertia.

The invention may, for example, be particularly suited for substituting a lighting device comprising a known thin polymer or thin metal sheet heat sink (plate-shape); because a lighting device with such a (plate-shape) heat sink requires effective thermal dissipation of heat generated by the light source, but also requires significant strength of the heat sink to cope with different occurring loads and resulting strain, or impacts. A thin metal sheet is therefore e.g. well suited due to the properties of the metal. Manufacturing a similar design polymer heat sink, wherein a similar thermal conductivity is achieved by implementing a high concentration thermally conductive filler throughout the heat sink, may not be able to meet said mechanical requirements; because the high concentration thermally conductive filler may deteriorate the resistance to mechanical failure of the heat sink, which resistance to mechanical failure is especially required due to the thin plate-shape, such as e.g. more resistance to break due to deformation.

However, the present invention provides an advantageous lighting device with a 3D-printed heat sink comprising a polymer material, which is effectively substituting such a (thin plate-shape) heat sink. Hence, in an embodiment, the lighting device according to the invention may be provided, wherein said stack comprises a plate-shape, wherein a thickness of said plate-shape is at least fifteen times smaller than an effective diameter of said stack; said effective diameter being twice the largest distance between the geometric center of the heat sink and an edge of the stack. The thickness of said plate shape is at least fifteen times smaller than said effective diameter; because a thicker plate-shape would in particular for lighting device design, for example light pole design, result in an overdesigned and bulky polymer heat sink. This unnecessary increases (material) costs and weight. As a result of such an embodiment, an advantageous lighting device is provided comprising a 3D-printed heat sink with a plate-shape.

Said effective diameter being also referred to in literature as equivalent diameter. For example, the effective diameter of a square is twice the largest between the geometric center of the square and one of the four corners of the square, because a circle may be drawn around those edges, the effective diameter not being the distance between the geometric center of the square and the middle point of one of the edges. Hence, said effective diameter may be analogous to the effective diameter as determined in pipe flow, wherein the cross section of a pipe provides a shape (e.g. circle, square). Said effective diameter may also be referred to as simply diameter.

Said thickness of said plate-shape may alternatively be at least twenty times smaller, at least thirty times smaller, at least forty times smaller, at least fifty times smaller, or at least sixty times smaller than an effective diameter of said stack; because for each of said thickness values the stack becomes less weighty and less expensive, while the invention may still provide the desired resistance to mechanical failure and thermal conduction, though decreasing. Said thickness may be a functional thickness. Therefore, the value of a thickness of at least sixty times smaller is an upper limit, as here the resistance to mechanical failure of the heat sink may not be sufficient in relation to the thermal conduction properties. Moreover, in an embodiment, said (functional) thickness of said plate-shape may be 20 millimeter, 10 millimeter, between 10 and 15 millimeter, 5 millimeter, at least 5 millimeter, 2 millimeter or at least 2 millimeter; because such specific thickness values are most common in luminaire (heat sink) design practice, such as for example light pole canopies with integrated heat sink.

A thickness corresponding to each layer individually may also be provided. The thickness of each layer individually may for example at least be 1 or 2 millimeter. The thickness of each layer may be set suitable to the type of printing process. The thickness of each layer individually may also be different, such as for example that the core layer has a higher individual thickness compared to the at least one further layer. The thickness of the layer without any thermally conductive filler may be at least twice, preferably four times, as large as one of the other layers.

Further, in an embodiment, said plate-shape of said stack comprises a curvature. Hence, the heat sink may be a bent plate or may comprise multiple bends. Such a curvature may be advantageous, because the lighting device and the heat sink may comprise (or may require) a curved design. Such a curvature may also be beneficial for cooling the heat sink surface.

Each of said layers may also comprise a diameter. In an embodiment, a layer diameter of the core layer and the at least one further layer, starting from the core layer, increases consecutively with each of the at least one further layer; the layer diameter being twice the largest distance between the geometric center and a furthest edge of a respective layer. As a result, relative to each other, the core layer may have a smaller layer diameter compared to the layer diameter of the at least one further layer. This is advantageous, because the at least one further layer, which as mentioned before may be mechanically stronger, has the larger layer diameter and therefore improving the resistance to mechanical failure of said 3D-printed heat sink. For example, the core layer may have a layer diameter of 500 millimeter or at least 500 millimeter; for a heat source such as CoB's with thermal load of 100 W and a diameter of 110 millimeter.

Alternatively, each layer may comprise an equal layer diameter, for example a layer diameter of 500 millimeter or at least 110 millimeter.

In an embodiment, the thermally conductive filler is at least one of: carbon, alumina, sapphire, spinel, AlON, BN, Y2O3, Si3N4, SiC or MgO, or any combination or mixture thereof. Such a thermally conductive filler is advantageous, because it is compatible with 3D-printing. In some examples, the type of thermally conductive filler amongst layers may be different.

In an embodiment, the polymer material is at least one of: ABS (acrylonitrile butadiene styrene), Nylon (or Polyamide), PVA (poly vinyl acetate), PLA (poly lactic acid), terephthalate (such as PET polyethylene terephthalate), Acrylate (polymethylacrylate, Perspex, polymethylmethacrylate, PMMA), Polycarbonate, Polypropylene (or polypropene), PS (polystyrene), PE (such as expanded-high impact-Polythene (or polyethene), Low concentration (LDPE) High concentration (HDPE)), Polyester, Silicone, PVC (polyvinyl chloride), Polychloroethene, or any composite thereof, or any combination or mixture thereof. Such a polymer material may be a thermoplastic. Such a polymer material is advantageous, because it is well compatible with 3D-printing, provides good strength and in combination with a thermally conductive filler good thermal properties, and is widely available for use in 3D-printing. Same polymer material indicates that the polymer matrix of the core layer and the at least further layer is compatible and adheres well between said layers. This also prevents delamination and the built up of internal stresses.

Optionally, the polymer material comprises a material selected from the group consisting of Urea formaldehyde, Polyester resin, Epoxy resin, Melamine formaldehyde, or rubber. Optionally, the polymer material comprises a material selected from the group consisting of a polysulfone, a polyether sulfone, a polyphenyl sulfone, or an imide (such as a poly ether imide).

The polymer material comprises a thermally conductive filler. This results in a composite material with a matrix and particles. In an embodiment, the thermal conductivity of the polymer material comprising the thermally conductive filler is at least 150 W/mK in plane. Such an embodiment may be a lower limit for thermal conduction, as with a lesser thermal conduction, the heat sink may not be sufficient in cooling. For example, carbon fiber fillers with polymer resins may provide a thermal conductivity in plane between 150 W/mK and 620 W/mK.

As mentioned before, a concentration of the thermally conductive filler in the polymer material decreases, starting from the core layer, consecutively with each of the at least one further layer for improving the resistance to mechanical failure and heat conduction of said 3D-printed heat sink. The effect of this configuration of the present invention is that the resistance to mechanical failure of the heat sink and the thermal conductivity of the heat sink may be inversely proportional along the stack of said layers. Said decrease in concentration may be provided as a (mathematical) function. Hence, in an embodiment, the decrease in concentration of said thermally conductive filler in said polymer material comprises a discretized function between the core layer and a final layer of the at least one further layer; wherein said discretized function is selected from the group of: linear, parabolic, exponential, step-function or logarithmic. Such an embodiment is advantageous, because controlling the function of the decrease in concentration of said thermally conductive filler provides more design freedom to meet thermal and mechanical requirements of said lighting device comprising said 3D-printed heat sink. For example, a 'linear decrease' may be well suited when the polymer material has sufficient strength when comprising the thermally conductive filler; an 'exponential decrease' may be well suited when the polymer material has less strength when comprising the thermally conductive filler and therefore requires providing more strength in the at least one further layer.

In the core layer, said concentration of thermally conductive filler in said polymer material may for example be, expressed in volume percentages of filler in matrix material, at least 10% thermally conductive filler, at least 20% thermally conductive filler, at least 30% thermally conductive filler, or at least 60% thermally conductive filler, or between 30% and 80% thermally conductive filler, or at most 80% thermally conductive filler. A thermally conductive filler concentration may be best suited within said range, because this may be a common range (less is thermally not desired, more may make the matrix material brittle) wherein the thermal conduction improves with increasing concentration. Said filler may for example be spherical particles, such as ceramic beads, or for example be fibers, or a combination thereof.

In an embodiment, the stack may comprise three layers, wherein the first layer comprises 25% thermally conductive filler, the second layer 10% thermally conductive filler, and the third layer 0% thermally conductive filler, being e.g. on average (if taken as a whole without layering) 7% thermally conductive filler; wherein the third layer may for example be a mechanical layer.

Said lighting device may be a luminaire or lighting fixture. Alternatively, said the invention may apply (mutatis mutandis) to an electronic device or object comprising an electronic device.

A lighting device will generally experience more mechanical load and/or deformation outdoor, due to environmental conditions such as wind, hail, rain, sunshine, and/or public usage. Outdoor lighting devices may therefore be designed to resists such mechanical loads and/or deformation. The light output of outdoor luminaires and the resulting heat generation is also commonly larger than indoor luminaires. Due to the higher heat generation, more thermal deformation e.g. may occur, leading to thermal strain. Due to hail, impact may be caused, which may lead to failure for more brittle materials. Wind loads may cause strain due to vibration or large deformation, which may lead to failure or rupture due to less ductility. Hence, the present invention may be well suited for an outdoor application, because the present invention provides an advantageous ratio of resistance to mechanical failure and heat conduction properties. That is, the present invention may provide a heat sink which is less brittle, more ductile, and more resistant against break due to deformation/strain; while the thermal properties are also improved.

The lighting device according to the invention may be an outdoor lighting device. In an embodiment, the lighting device may be an outdoor lighting device. Such an outdoor lighting device may be characterized by weather resistance, for example resistant against moisture/dust ingression, for example Ingress Protection IP rating 6, or (UV) sunlight, mechanical overdesign for ensuring strength or periodical loading.

Furthermore, for example, the lighting device according to the invention may be arranged for outdoor application, wherein a face of the 3D-printed heat sink may be arranged for dissipating heat to an outdoor environment. As the heat sink is arranged for dissipating heat to an outdoor environment, such as being directly in contact with harsh outdoor conditions, or indirectly by intermediate mechanical components, the lighting device will experience many mechanical and thermal loads. The lighting device according is therefore well suited and may be an advantageous substitute for a lighting device with a known polymer heat sink or a metal heat sink, and may be an improved lighting device with a 3D-printed heat sink.

Furthermore, in an embodiment, the 3D-printed heat sink of the lighting device may comprise a rib, for example a radial rib at the surface of the heat sink extending from an edge into the direction of the geometric center of the heat sink. Said heat sink may also comprise a plurality of such ribs, which may extend half way to the geometric center of the heat sink. This is advantageous, as the outer edges of the heat sink may comprise less strength and stiffness, hence the ribs improving the stiffness of the heat sink locally.

In an embodiment, the heat sink is part of a housing of the lighting device. A housing may be an enclosure or protective enclosure. Yet in a further embodiment, the heat sink is part of a lighting device canopy. As the canopy of a lighting device may experience high mechanical loads, such as harsh weather conditions (loading by wind, day-night cooling cycle, rain, hail, snow, on/off cyclical loads, or thermal cyclical stress by sunshine), or internal thermal/mechanical stresses due to construction and/or components, the heat sink of the present invention will be advantageous in meeting the mechanical requirements when part of a lighting device canopy (and/or part of an enclosure of the lighting device).

In an embodiment, the thermally conductive filler comprises fibers oriented in radial direction for improving a dissipation of heat in radial direction (e.g. originating from a light source); said radial direction being a direction perpendicular to the stack axis and oriented from a geometric center of the stack towards an edge of the stack. Such an embodiment is advantageous in dissipating the heat e.g. originating from a light source or any other thermal load; because the fibers will transfer heat along their oriented radial direction away to the edge of the stack. Alternatively, said fibers may be oriented towards an active cooling element and/or cooling area in a respective layer.

In an embodiment, each of the at least one consecutive layer comprises a circular shape, said circular shape being concentric with the core layer. Such an embodiment, wherein the heat sink comprises a stack of layers with a circular shape, is advantageous in dissipating the heat due to the uniform distance of a circle in all directions, wherein the heat may be originating from a light source or any other thermal load.

Alternatively, said shape may be square, triangular, star shape, octagonal, pentagon, hexagonal, and/or any other shape with equal distance to a geometric center. Alternatively, or optionally, each of the at least one consecutive layer comprises a different shape, said different shape being concentric with the core layer. Said concentricity may be around the respective stack axis.

The thermally conductive filler may be present in various forms. Such a filler may be particles, fibers, or a continuous fiber. Such a continuous fiber is a relatively long and continuous fiber (e.g. string, wire, fiber) within the polymer matrix compared to fibrous fillers. Hence, in an embodiment, the core layer and the at least one consecutive layer comprise a continuous fiber for improving heat transfer in the heat sink. Such an embodiment is advantageous, as a continuous fiber may be easily arranged advantageously to provide heat dissipation in a desired direction, while preserving resistance to mechanical failure due to the local application of the continuous fiber. Such a continuous fiber may for example be oriented in a spiral pattern, a spider in a web pattern, or in a zigzagging pattern around a geometric center. Said continuous fiber as such (and the characteristics falling under said definition) is clear in the field of 3D-printing. Said continuous fiber may be printed along with the polymer material and deposited in the desired pattern in the 3D-printed heat sink, or may be deposited separately/independently during the 3D-printed process, such as e.g. placement of continuous fiber.

The lighting device according to the invention may be advantageously applied in a condition wherein a heat sink of a lighting device may require a thin shape and limited complexity, while enabling high thermal conductivity and resistance to mechanical failure. Hence, in an embodiment, the 3D-printed heat sink comprises consecutively the stack of the core layer, a first further layer and a second further layer; wherein said stack comprises a plate-shape, wherein a thickness of said plate-shape is at least fifteen times smaller than an effective diameter of said stack; said effective diameter being twice the largest distance between the geometric center of the heat sink and an edge of the stack; wherein a layer diameter of the core layer is smaller than the layer diameter of the first further layer, and the layer diameter of the first further layer is smaller than the layer diameter of the second further layer, said layer diameter being the largest distance between the geometric center and a furthest edge of a respective layer; wherein the first further layer and the second further layer comprise a circular shape, said circular shape being concentric with the core layer; and wherein the decrease in concentration of said thermally conductive filler in said polymer material comprises a discretized linear function between the core layer, the first further layer and the second further layer; and wherein the heat sink is part of an enclosure of the lighting device. Such an embodiment, as also partly mentioned before, provides a lighting device able to resist undesired mechanical loads and able to provide a desired thermal performance, while maintaining a simple and easy to produce 3D-printed heat sink design.

Further, in an embodiment, one of the at least one further layer may comprise fins for transferring heat between the heat sink and a fluid. Such an embodiment may improve heat transfer. Such a fluid may be air, nitrogen, oxygen, other inert gasses; or may be water, coolant or refrigerant (such as R123A), liquid nitrogen, or other liquids. Said fluid may be an ambient fluid, such as ambient air. Furthermore, such a fluid may be dedicated for forced convection. In examples, said at least one further layer may comprise channels, wherein the channels may be arranged for accommodating the fluid and/or for flowing (pumping/forcing) the fluid.

It is a further object of the invention to provide an improved heat sink. Therefore the invention provides a heat sink having all the characteristics of the heat sink comprised within a lighting device according to the invention. The embodiments and corresponding advantages related to said heat sink comprised within the lighting device may also apply mutatis mutandis to the improved heat sink provided in the further object of the invention here.

It is a further object of the invention to provide an improved method of producing a lighting device comprising a light source and/or an electronic device, and comprising a 3D-printed heat sink. Hence, in an embodiment, a method is provided of producing a lighting device comprising a light source and/or electronic device, and comprising a 3D-printed heat sink, the 3D-printed heat sink comprises a stack of: a core layer and at least one further layer stacked along a stack axis normal to the core layer, the method comprising: 3D-printing a core layer with a polymer material comprising a thermally conductive filler, wherein the thermally conductive filler is present in the core layer in a concentration; 3D-printing, stacked to the core layer, at least one further layer with the same polymer material comprising the thermally conductive filler, wherein the concentration of the thermally conductive filler in the polymer material decreases, starting from the core layer, consecutively with each of the at least one further layer for improving resistance to mechanical failure and heat conduction of said 3D-printed heat sink; Arranging a light source and/or electronic component onto the core layer providing the lighting device. The method may, in some examples, further comprise assembling the 3D-printed heat sink and the arranged light source, which thus provide the lighting device, into a luminaire. Such a method of producing a lighting device comprising a 3D-printed heat sink is advantageous, because producing such a lighting device comprising such a heat sink allows for cost-effectively producing small batch sizes and allows for personalized products.

As mentioned, said method of producing a lighting device comprising a 3D-printed heat sink may comprise arranging an electronic component onto the core layer. Said electronic component may be a driver. Hence, in examples, either a light source or an electronic component such as e.g. a driver may be arranged onto the core layer; or in other examples both the light source and the electronic component such as e.g. a driver may be arranged together on the core layer. This is advantageous, as all heat producing elements of a lighting device may be arranged on the heat sink according to the invention, and onto the core layer, which is the layer from which heat is most effectively transferred away.

Where applicable, embodiments referring to the lighting device as mentioned before, may apply mutatis mutandis to said method of producing a lighting device comprising a 3D-printed heat sink.

The arranged light source in said method may alternatively be a second electronics device, such as a sensor, display, battery, or controller.

In an aspect of the invention, a lighting device is provided comprising a 3D-printed heat sink; the 3D-printed heat sink comprises a stack of a core layer and a top layer; wherein the core layer and the top layer comprise a same polymer material each with a thermally conductive filler, wherein a concentration of the thermally conductive filler in the polymer material decreases per layer from the core layer to the top layer. Further, said lighting device may be provided, further comprising at least one intermediate layer in between the core and the top layer. The embodiments and corresponding advantages related to said lighting device may also apply mutatis mutandis to the device provided in the aspect of the invention here.

In a paragraph, it is further an object of the invention to provide a lighting device comprising a 3D-printed heat sink; the 3D-printed heat sink comprises a stack of a core layer and at least one further layer stacked consecutively along a stack axis normal to the core layer; wherein the core layer and the at least one further layer comprise a same polymer material each with a thermally conductive filler, wherein a concentration of the thermally conductive filler in the polymer material decreases, starting from the core layer, consecutively with each of the at least one further layer for improving the resistance to mechanical failure and heat conduction of said 3D-printed heat sink.

BRIEF DESCRIPTION OF THE DRAWINGS

The invention will now be further elucidated by means of the schematic non-limiting drawings:

FIG. 4 depicts schematically, within charts, simulation results indicating that the resistance to mechanical failure of an embodiment of the 3D-printed heat sink are improved compared to a 3D-printed heat sink with a uniform distribution of thermally conductive filler with a high concentration, while the thermal performance remains similar.

DETAILED DESCRIPTION OF THE EMBODIMENTS

Figure 1:
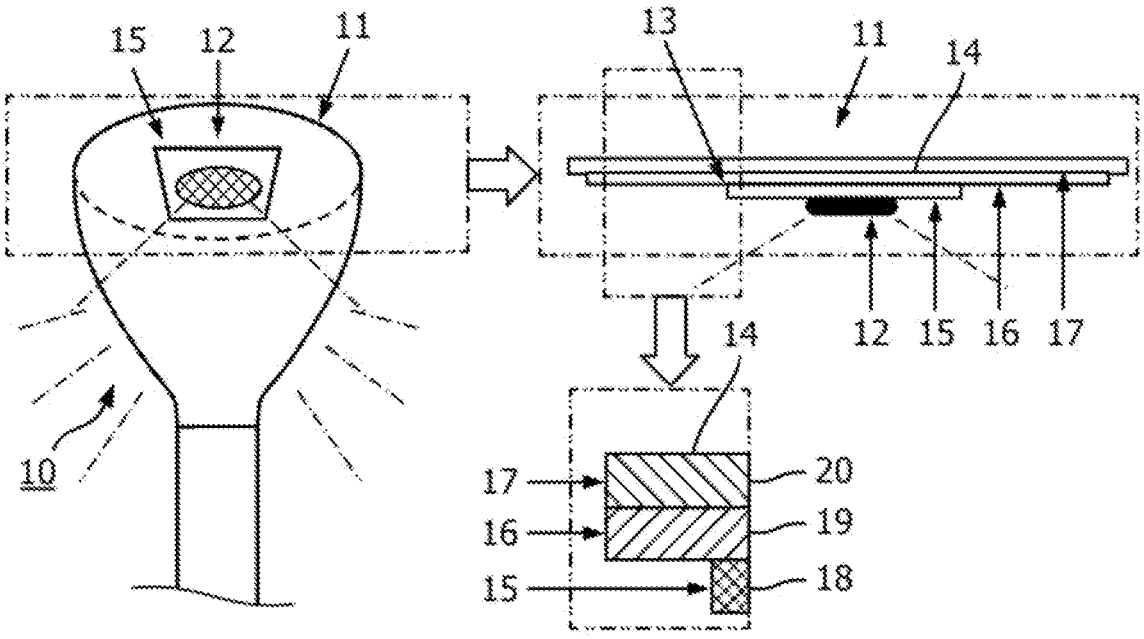
FIG. 1 depicts schematically an embodiment of a lighting device comprising a light source and a 3D-printed heat sink.

FIG. 1 depicts schematically, by non-limiting example, an embodiment of a lighting device 10 comprising a 3D-printed heat sink 11. FIG. 1 also depicts an embodiment of the heat sink 11 according to the invention. The lighting device 10 is an outdoor lighting device, such as similar to e.g. a Philips Lighting post-top outdoor luminaire, e.g. the Philips Lighting Metronomis. Here, the lighting device is arranged onto a light pole. The 3D-printed heat sink 11 is (for the large part) circular of shape and is part of the enclosure of the lighting device, in particular part of the lighting device canopy of the lighting device 10. (Currently, e.g. the Philips Lighting Metronomis comprises a metal canopy which is die casted with a dedicated mold). As a result, the heat sink 11 comprises a face which is arranged for dissipating heat to an outdoor environment. Such a heat sink 11 is efficient in dissipating heat, since an airflow in an outdoor setting may force a convective flow transferring heat from the lighting device away to the surroundings.

Alternatively, said 3D-printed heat sink may be of square, triangular, octagonal, rectangular, star-shaped, elliptical, or any other suitable shape for a lighting device canopy. Alternatively, said 3D-printed heat sink may be part of another section of the enclosure of the lighting device, such as a face of a lighting device, a standard like a pole, a lid, a housing, or an optical cover.

Referring to FIG. 1, the 3D-printed heat sink 11 comprises a stack 13 of a core layer 15 and (consecutively) at least one further layer 16, 17 stacked along a stack axis normal to the core layer 15; wherein FIG. 1 depicts a first further layer 16 and a second further layer 17. The core layer 15 and the at least one further layer (first further layer 16 and second further layer 17) comprise a same polymer material 14 each with a thermally conductive filler 18,19,20; wherein the concentration of the thermally conductive filler 18,19,20 in the polymer material 14 decreases, starting from the core layer 15 (said concentration core layer also indicated as 18), consecutively with each of the at least one further layer, which are the first further layer 16 and the second further layer 17 (said concentration of first further layer also indicated as 19, said concentration of second further layer also indicated as 20). This configuration of layers 15, 16, 17 and corresponding decrease in concentration of thermally conductive filler 18, 19, 20 in the polymer material 14 improves the (overall) resistance to mechanical failure of said 3D-printed heat sink 11. Hence, the resistance to mechanical failure and heat conduction of said 3D-printed heat sink 11 is improved.

The core layer 15 comprises a square shape. Alternatively, preferably, said core layer comprises a circular shape for dissipating heat originating from a heat source. Said shape may also be a different shape such as triangular, elliptic, hexagonal, octagonal, etc. Furthermore, each of the at least one further layer, here the first further layer 16 and the second further layer 17, comprises a circular shape, said circular shape being concentric with the square core layer 15. Alternatively, the at least one further layer may each have a different shape, wherein each layer is concentric with the core layer. Such a concentric arrangement, wherein the shapes are basic geometric shapes, may allow for better heat distribution of a light source arranged at the geometric center of the core layer.

Furthermore, still referring to FIG. 1, the stack 13 comprises a plate-shape. Said plate-shape is at least fifteen times smaller than an effective diameter of said stack 13; said effective diameter being twice the largest distance between the geometric center of the heat sink and an edge of the stack 13. Here, the effective diameter is the diameter of the canopy (i.e. heat sink 11). Furthermore, a layer diameter may be defined as twice the largest distance between the geometric center and a furthest edge of a respective layer. Here, the layer diameter of the core layer 15 and the at least one further layer 16, 17, starting from the core layer 15, increases consecutively with each of the at least one further layer 16, 17. Thus, the layer diameter of the core layer 15 is smaller than the layer diameter of the first further layer 16, and the layer diameter of the first further layer 16 is smaller than the layer diameter of the second further layer 17.

Still referring to FIG. 1, the lighting device 10 comprises a light source 12. Said light source 12 is a semiconductor lighting device comprising multiple Chip on Board elements on a substrate LED board. Alternatively, said light source may be a conventional light source or a luminescent material onto a transparent or translucent substrate. Said light source 12 is arranged on the core layer 15. The light source 12 is arranged or positioned at the geometric center of the core layer 15. Alternatively, said light source may be positioned at another position on the core layer. (In case the light source is a luminescent material on a transparent or translucent substrate, said substrate may be arranged onto the core layer in an inseparable construction, e.g. in some cases printed together with the 3D-printed heat sink).

Said polymer material 14 is Polycarbonate. The thermally conductive filler 18, 19, 20 is carbon, more specifically carbon fibers. Alternatively, the thermally conductive filler is one of: carbon, alumina, sapphire, spinel, AlON, BN, Y2O3, Si3N4, SiC or MgO. Alternatively, said thermally conductive filler may be partly substituted by the thermally conductive fillers mentioned here. And the polymer material is one of ABS, Nylon, PVA, PLA, terephthalate, PMMA, Polycarbonate, Polypropylene, Polystyrene, PE, Polyester, Silicone, PVC, or any composite thereof, or any combination or mixture thereof. Alternatively, said polymer material may be partly be substituted by the polymer material mentioned here. As mentioned before, the concentration of the thermally conductive filler 18, 19, 20 in the polymer material 14 decreases, starting from the core layer 15, consecutively with each of the at least one further layer 16, 17. Referring to FIG. 1, the decrease in concentration of said thermally conductive filler 18, 19, 20 in said polymer material 14 comprises a discretized function between the core layer 15 and the second further layer 17. Said discretized function is linear. That is: the concentration of said thermally conductive filler 18, 19, 20 in said polymer material 14 linearly decreases from the core layer, the first further layer, and the second further layer. Respectively, 60% volume percentage thermally conductive filler 18 in the core layer 15; 40% volume percentage thermally conductive filler 19 in the core layer 16; and 20% volume percentage thermally conductive filler 20 in the core layer 17. This is also is depicted schematically in FIG. 1 with a texture fill. Alternatively, said decrease in concentration may be parabolic, exponential, step-function or logarithmic. Alternatively, said percentage filler may be different, such as respectively e.g. 30%-20%-10%. The thermally conductive filler 18, 19, 20, which is carbon fiber, is oriented in radial direction (not depicted) for improving the dissipation of heat from the core layer 15, to the first further layer 16, to the second further layer 17. The radial direction is the direction being a direction perpendicular to the stack axis, i.e. the direction in which the core layer 15 and at least one further layer 16, 17 are stacked, and oriented from the geometric center of the stack towards an edge of the stack.

As a result, the core layer 15 may provide less resistance to mechanical failure but higher thermal conductivity, and the at least one further layer 16, 17, may consecutively provide increasing resistance to mechanical failure and decreasing thermal conductivity. The effect of this configuration is that the resistance to mechanical failure of the heat sink 11 and the thermal conductivity of the heat sink 11 may be inversely proportional along the stack 13 of said layers 15, 16, 17. Consequently, heat applied to the core layer 15 of the heat sink 11 by means of the light source 12 may be dissipated faster over the stack 13 of layers 15, 16, 17, while the resistance to mechanical failure of the heat sink may be preserved accordingly.

The advantage of such a lighting device 10 according to the invention is that a lighting device 10 is provided with an improved 3D-printed (polymer) heat sink 11. The heat sink 11 is for example an advantageous substitute for a known polymer heat sink or a metal heat sink in said lighting device 10; because the lighting device 10 comprising said 3D-printed heat sink 11 is amongst others easier and faster to produce, is more cost-effectively to manufacture in larger numbers, and is providing a heat sink 11 with improved or advantageous relation of resistance to mechanical failure and heat conduction properties.

Figure 2:
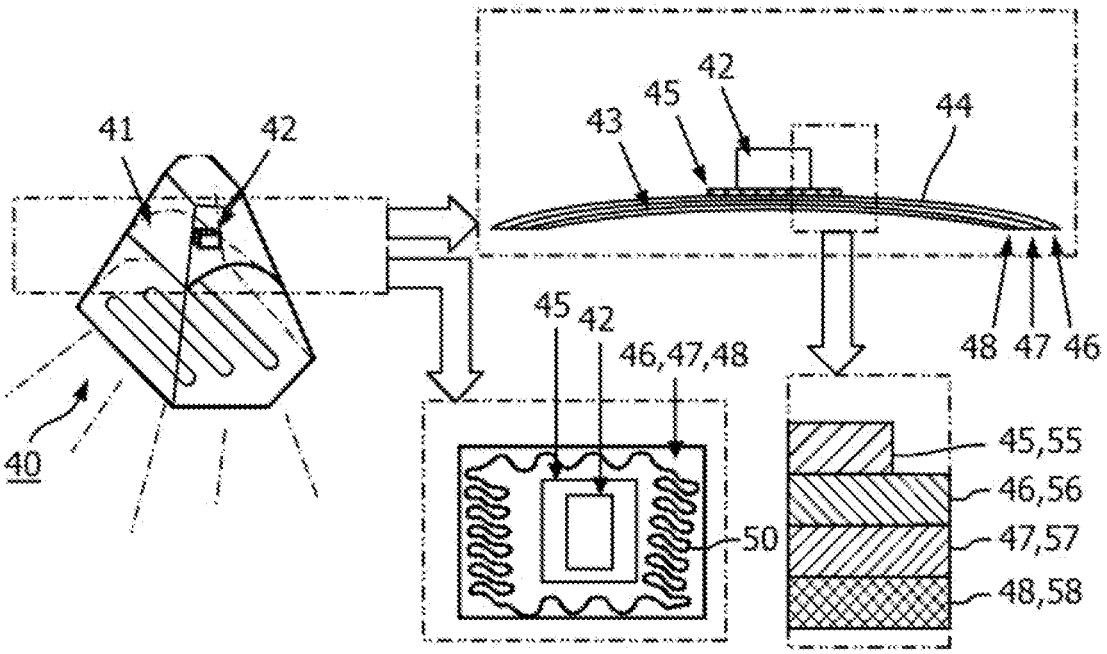
FIG. 2 depicts schematically an embodiment of a lighting device comprising an electronic device (being a driver) and a 3D-printed heat sink.

FIG. 2 depicts schematically, by non-limiting example, an embodiment of a (hanging) lighting device 40 comprising a 3D-printed heat sink 41; which is partly similar to the embodiment depicted in FIG. 1, but now wherein the lighting device 40 is applied indoor and the heat sink 41 is an internal component of the lighting device 40. FIG. 2 also depicts an embodiment of the heat sink 41 according to the invention.

Referring to FIG. 2, the 3D-printed heat sink 41 comprises a stack 43 of consecutively a core layer 45 and at least one further layer 46, 47, 48. FIG. 2 depicts a first further layer 46, a second further layer 47, and a third further layer 48. The core layer 45 and the first 46, second 47 and third 48 further layer comprise a same polymer material 44 each with a thermally conductive filler 55, 56, 57, 58. The concentration of the thermally conductive filler 55, 56, 57, 58 in the polymer material 44 decreases, starting from the core layer 45, consecutively with each of the at least one further layer 46, 47, 48. This configuration of layers 45, 46, 47, 48 and corresponding decrease in concentration of thermally conductive filler 55, 56, 57, 58 in the polymer material 44 improves the resistance to mechanical failure and thermal conduction of said 3D-printed heat sink 41.

The core layer 45 comprises a rectangular shape. Each of the at least one further layer, here the first further layer 46, the second further layer 47, and the third further layer 48 comprises a rectangular shape. The shape of each layer 46, 47, 48 is concentric with the rectangular core layer 45.

Furthermore, still referring to FIG. 2, the stack 43 comprises a plate-shape. Said plate-shape is at least fifteen times smaller than an effective diameter of said stack 43; said effective diameter being twice the largest distance between the geometric center of the heat sink and an edge of the stack 43. The plate-shape of said stack 43 comprises a curvature, which is required to fit the heat sink 41 within the lighting device 40. Furthermore, a layer diameter may be defined as twice the largest distance between the geometric center and a furthest edge of a respective layer. Here, the layer diameter of the core layer 45 is smaller than the at least one further layer 46, 47, 48. The layer diameter of the first 46, second 47 and third 48 further layer are identical (considering the stack 13 flat by leaving out the slight curvature present in the stack 13).

Still referring to FIG. 2, the lighting device 40 comprises an electronic device. Here, the electronic device is a driver 42. Alternatively, said electronic device may be a battery, a processor, a resistance, a driver, an actuator, a chip or a semiconductor device, or a display. Said driver 42 is arranged on the core layer 45. Such a driver generates a significant amount of heat, which is desired to be dissipated effectively. Furthermore, the polymer material 44 is Polyethylene with a thermally conductive filler 55, 56, 57, 58 comprising MgO particles. Alternatively, the type of thermally conductive filler amongst layers may be different. Alternatively, as mentioned before, said polymer material and/or said thermally conductive filler may be partly be substituted by the respective materials/fillers mentioned before. To further improve heat transfer, (only) the first further layer comprises (here) a continuous fiber 50 made of carbon fiber for improving heat transfer in the heat sink. Said fiber is arranged in a pattern 50 predominantly in the longest length direction of the first further layer 46. Alternatively, said pattern may be a spiral concentrically arranged around the core layer, or a spider in a web pattern.

Figure 3:
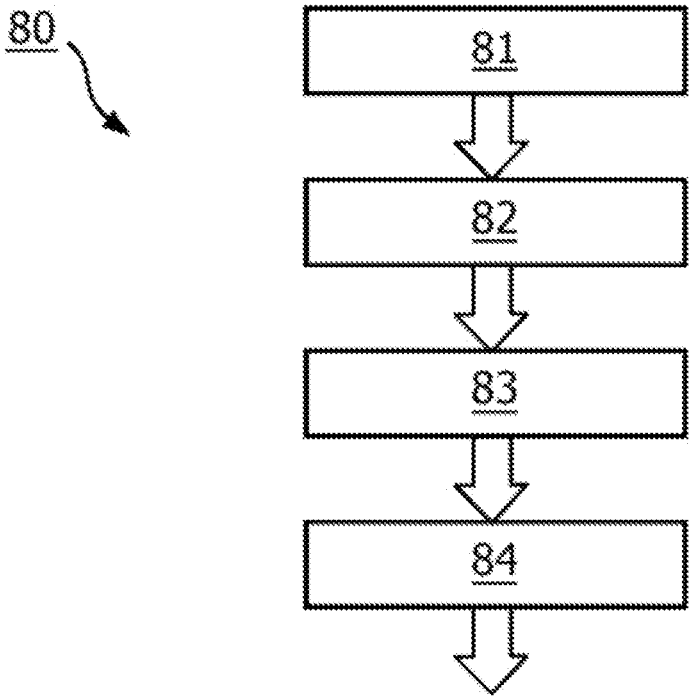
FIG. 3 depicts schematically, within a flowchart, an embodiment of a method of producing a lighting device comprising a 3D-printed heat sink.

FIG. 3 depicts schematically, within a flowchart, an embodiment of a method 80 of producing a lighting device comprising a 3D-printed heat sink. The 3D-printed heat sink comprises a stack of: a core layer and at least one further layer stacked along a stack axis normal to the core layer. For example a core layer and five further layers. The method 80 comprises the step 81 of 3D-printing a core layer with a polymer material comprising a thermally conductive filler, wherein the thermally conductive filler is present in the core layer in a concentration. Alternatively, said code layer may already be provided as a substrate of 3D-printing onto which a further printing structure may be printed. Subsequently, the method provides the step 82 of 3D-printing, stacked to the core layer, at least one further layer (e.g. the five further layers) with the same polymer material comprising the thermally conductive filler. Here, the concentration of the thermally conductive filler in the polymer material decreases, starting from the core layer, consecutively with each of the at least one further layer for improving the resistance to mechanical failure of said 3D-printed heat sink. A further step 83 of the method comprises arranging a light source onto the core layer, providing the lighting device. Said light source may alternatively be an electronic device which generates heat such as a driver or battery. Yet another further step 84 of the method comprises assembling the 3D-printed heat sink with light source, i.e. the resulting lighting device, into a luminaire.

Such a method 80 of producing a lighting device comprising a 3D-printed heat sink is advantageous, because producing such a lighting device comprising such a heat sink allows for cost-effectively producing small batch sizes and allows for personalized products.

Figure 4:
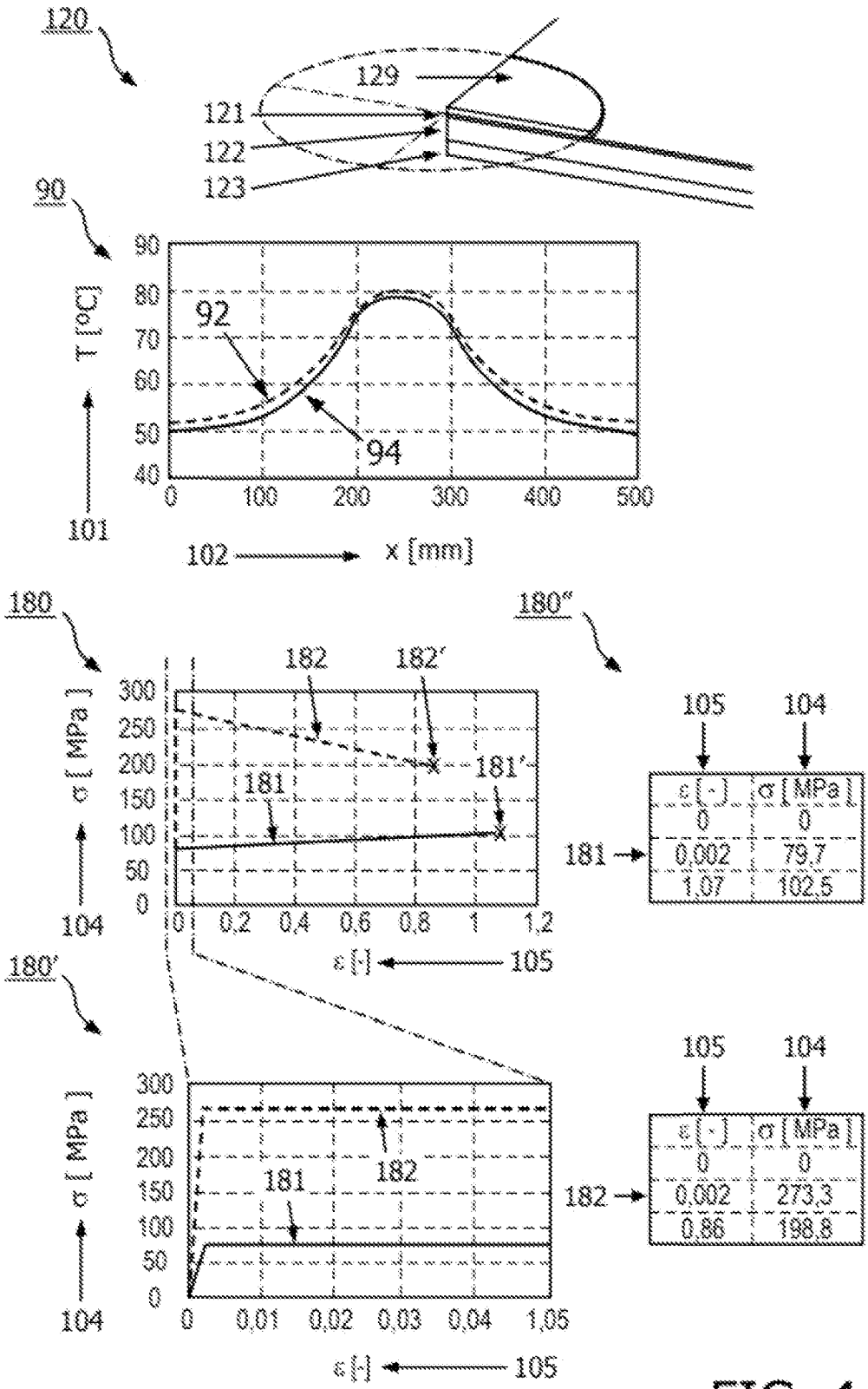

FIG. 4 depicts schematically, by non limiting example, simulation results related to an embodiment of the 3D-printed heat sink according to the invention, which prove the improved resistance to mechanical failure (or e.g. mechanical strength) and heat conduction. This will be elucidated in more detail below.

A mechanical/thermal simulation is performed with the program Ansys. A simulation model 120 is constructed for the lighting device according to the invention, wherein the lighting device comprises a 3D-printed heat sink. (Note that the simulation model 120 is depicted here as a quarter piece to allow the layers to be visualized in the figure). Referring to FIG. 4, the simulation model 120 is constructed according to an embodiment of the present invention and with the following boundary conditions. In the simulation model 120, the 3D-printed heat sink comprises a core layer 121, a second layer 122 and a third layer 123; wherein all layers are circular disks with a diameter of 500 mm. A circular LED board 129 is arranged on the geometric center of the core layer 121. Each of said layer comprises the same polymer material, here i.e. Polycarbonate. The core layer 121 is of 0.5 mm thickness and comprises a thermally conductive filler with a concentration of 25%; the second layer 122 is of 10 mm thickness and comprises the same thermally conductive filler with a concentration of 10%; the third layer 123 is of 5 mm thickness and does not comprise the thermally conductive filler (thus 0%). Said thermally conductive filler used for the simulation model 120 is M55J Toray Carbon Fiber.

Next to the geometric setup of the simulation model, also the environmental boundary conditions are set for simulation. The 3D-printed heat sink is considered a statically supported canopy. The Ambient air is set to 35 degrees Celsius, natural convection is applied as 8 $W/m^2K$ on all surfaces, radiative heat transfer is modelled with emissivity 1 and radiated towards the complete surrounding at 35 degrees Celsius, and 100 Watt heat is applied at the circular LED board. Such boundary conditions mimic real outdoor conditions, e.g. when the lighting device according to the invention is applied as street lighting, e.g. pole top.

Next to the simulation model 120 as described above, now referred to as 'the invention', two reference heat sinks are modelled and simulated referred to as 'uniform heat sink' and 'no filler heat sink'. The 'uniform heat sink' comprises the same geometry as 'the invention', but contains a uniform thermally conductive filler concentration of 25% throughout. The 'no filler heat sink' comprises the same geometry as 'the invention', but contains no thermally conductive filler concentration, and is made completely of Polycarbonate alone. The 'no filler heat sink' is not depicted in FIG. 4 for convenience, but its results referred to when required below.

With the geometry of the simulation model 120, simulations are performed for 'the invention', 'uniform heat sink', and 'no filler heat sink'. Still referring to FIG. 4, results of said simulations show the following:

First, considering the thermal results 90, the temperature 101 of the heat sink is plotted against the diameter 102 of the heat sink. The thermal results 90 depict both 'the invention' 91 and the 'uniform heat sink' 92. The 'no filler heat sink' is not depicted. The thermal results 90 indicate that the temperature distribution 101 of 'the invention' 91 and the 'uniform heat sink' 92 are similar and close; i.e. the distribution differs locally only a few degrees Celsius. The 'uniform heat sink' 92 is performing thermally better, as expected, because its thermally filler content is of higher concentration, is more available, and applied uniformly throughout. However, the thermal results 90 indicate that both 'the invention' 91 as well as the 'uniform heat sink' 92 perform equally well, even though 'the invention' 91 comprises less thermally conductive filler material. Nevertheless, the applied gradient according to the invention is still sufficiently able to transfer the heat away from the LED board 129. For the 'no filler heat sink', a hot spot is present up to 270 degrees Celsius at the LED board 129, because the insulating properties of the polymer material do not allow heat to be transferred away from the center of the heat sink.

All in all, the thermal results 90 conclude that in 'the invention' 91 the thermal performance of the heat sink is preserved due to applying the gradient according to the invention, compared to the 'uniform heat sink' 92 case. Without the architecture of layers according to the invention, the temperature distribution 101 of the heat sink would render a hot spot.

Second, still referring to FIG. 4, considering the mechanical results 180, 180', 180", a stress-strain curve 180 is depicted for both 'the invention' 181 and the 'uniform heat sink' 182, wherein a second more detailed (zoomed in) plot of the stress-strain curve in the elastic region 180' is also depicted for convenience. Tabular values 180" are also presented. Said stress-strain curve 180, 180' depicts relevant mechanical properties. The stress-strain curve 180, 180' shows that the 'uniform heat sink' 182 comprises more stiffness compared to 'the invention' 181, since the slope in the elastic region is higher. The 'uniform heat sink' 182 may take more stress 104. However, a stiffer material is less impact resistant, hence 'the invention' 182 provides better mechanical properties with respect to impact resistance. Moreover, for a similar strain (or deformation, or elongation), a higher stress 104 occurs in the 'uniform heat sink' 181, hence 'the invention' 181 being more ductile. Furthermore, the stress-strain curve 180 also clearly indicates that 'the invention' 181 is able to resist more strain 105 before break (at point 181') compared to the 'uniform heat sink' 182. The break point 182' of the 'uniform heat sink' 182 is earlier than 'the invention' 181 when looking at strain 105. This is due to the fact that the 'uniform heat sink' 182 comprises a higher thermally conductive filler concentration, hence making the material thermally slightly better, but mechanically worse in terms of brittleness, because the 'uniform heat sink' case 182 is not able to resist larger strains 105 compared to 'the invention' 181; which is disadvantageous in outdoor environments wherein weather conditions or operating conditions may cause strain, deformation and an amplitude of vibration.

As a result, it is proven that the resistance to mechanical failure (i.e. in the properties explained above) of a polymer decreases, as the concentration of the thermally conductive filler in the polymer material increases. More specifically, the resistance to mechanical failure here is referring to the brittleness and ductility: The brittleness (and/or stiffness) of the stacked layers increases for increasing thermally conductive filler content, making the stack deteriorate in ductility and prone to break or rupture sooner by deformation or strain. Although it is thermally desired to implement a thermally conductive filler, it is therefore not mechanically desired to provide each layer of said stack with a high concentration of thermally conductive filler. Hence, as mentioned before, the invention provides a 3D-printed heat sink, wherein a concentration of the thermally conductive filler in the polymer material decreases, starting from the core layer, consecutively with each of the at least one further layer for improving resistance to mechanical failure and heat conduction of said 3D-printed heat sink. This renders the 3D-printed heat sink to have a relatively high resistance to mechanical failure properties (such as ductility and higher breakpoint due to strain) while inventively preserving thermal performance. The present invention is advantageous in case of deformation or impact due to weather conditions, such as impact of hail, deformation due to wind, thermal strain, etc.

The invention claimed is:

1. A lighting device comprising a light source and/or an electronic component, and comprising a 3D-printed heat sink;

the 3D-printed heat sink comprises a stack of a core layer and at least one further layer stacked along a stack axis normal to the core layer;

wherein the core layer and the at least one further layer comprise a same polymer material, wherein a concentration of the thermally conductive filler in the polymer material decreases, starting from the core layer, consecutively with each of the at least one further layer for improving resistance to mechanical failure and heat conduction of said 3D-printed heat sink.

2. The lighting device according to claim 1, wherein the light source and/or the electronic component is arranged on the core layer.

3. The lighting device according to claim 2, wherein the light source and/or the electronic component is positioned at a geometric center of the core layer.

4. The lighting device according to claim 1, wherein said stack comprises a plate-shape, wherein a thickness of said plate-shape is at least fifteen times smaller than an effective diameter of said stack; said effective diameter being twice the largest distance between a geometric center of the heat sink and an edge of the stack.

5. The lighting device according to claim 1, wherein a layer diameter of the core layer and the at least one further layer, starting from the core layer, increases consecutively with each of the at least one further layer;

the layer diameter being twice the largest distance between a geometric center and a furthest edge of a respective layer.

6. The lighting device according to claim 1, wherein the thermally conductive filler is at least one of: carbon, alumina, sapphire, spinel, AlON, BN, Y203, Si3N4, SiC or MgO.

7. The lighting device according to claim 1, wherein the polymer material is at least one of: ABS, Nylon, PVA, PLA, terephthalate, PMMA, Polycarbonate, Polypropylene, Polystyrene, PE, Polyester, Silicone, PVC, or any composite thereof.

8. The lighting device according to claim 1, wherein the decrease in concentration of said thermally conductive filler in said polymer material comprises a discretized function between the core layer and a final layer of the at least one further layer; wherein said discretized function is selected from the group of: linear, parabolic, exponential, step-function or logarithmic.

9. The lighting device according to claim 1, wherein the lighting device is an outdoor lighting device.

10. The lighting device according to claim 1, wherein the heat sink is part of a housing of the lighting device.

11. The lighting device according to claim 1, wherein the heat sink is part of a lighting device canopy.

12. The lighting device according to claim 1, wherein each of the at least one further layer comprises a circular shape, said circular shape being concentric with the core layer.

13. The lighting device according to claim 1, wherein the 3D-printed heat sink comprises consecutively the stack of the core layer, a first further layer and a second further layer;

wherein said stack comprises a plate-shape, wherein a thickness of said plate-shape is at least fifteen times smaller than an effective diameter of said stack; said effective diameter being twice the largest distance between the geometric center of the heat sink and an edge of the stack;

wherein a layer diameter of the core layer is smaller than the layer diameter of the first further layer, and the layer diameter of the first further layer is smaller than the layer diameter of the second further layer, said layer diameter being twice the largest distance between the geometric center and a furthest edge of a respective layer;

wherein the first further layer and the second further layer comprise a circular shape, said circular shape being concentric with the core layer; and wherein the decrease in concentration of said thermally conductive filler in said polymer material comprises a discretized linear function between the core layer, the first further layer and the second further layer; and wherein the heat sink is part of an enclosure of the lighting device.

14. A method of producing a lighting device comprising a light source and/or an electronic device, and comprising a 3D-printed heat sink, the 3D-printed heat sink comprises a stack of: a core layer and at least one further layer stacked along a stack axis normal to the core layer, the method comprising:

3D-printing a core layer with a polymer material comprising a thermally conductive filler, wherein the thermally conductive filler is present in the core layer in a concentration;

3D-printing, stacked to the core layer, at least one further layer with the same polymer material, wherein the concentration of the thermally conductive filler in the polymer material decreases, starting from the core layer, consecutively with each of the at least one further layer for improving resistance to mechanical failure and thermal conduction of said 3D-printed heat sink;

Arranging a light source onto the core layer providing a lighting device.

15. The method according to claim 14, the method further comprising:

Arranging an electronic component onto the core layer.

* * * * *